US006338421B1

(12) United States Patent
Rush et al.

(10) Patent No.: US 6,338,421 B1
(45) Date of Patent: Jan. 15, 2002

(54) CRACK-RESISTANT CONTAINER LID HAVING OPENING

(75) Inventors: Jonathan E. Rush, Easton; Philip D. Scalvini, Jr.; Thomas R. Toczek, both of Nazareth, all of PA (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/443,287

(22) Filed: Nov. 19, 1999

Related U.S. Application Data

(60) Provisional application No. 60/109,282, filed on Nov. 20, 1998.

(51) Int. Cl.[7] ..... B65D 41/18

(52) U.S. Cl. ..... 220/780; 220/782; 220/729; 220/731

(58) Field of Search ..... 220/731, 254, 220/780, 782, 367.1, 694, 729; 426/101, 519, 393; 364/347; D9/431, 434, 435

(56) References Cited

U.S. PATENT DOCUMENTS

| | | | | | |
|---|---|---|---|---|---|
| 947,922 | A | * | 2/1910 | Lewis | 2220/731 |
| 2,802,499 | A | * | 8/1957 | Tupper | 220/731 |
| 2,873,052 | A | * | 2/1959 | Atherton | 220/731 |
| 3,307,602 | A | | 3/1967 | Boster | |
| 3,856,314 | A | * | 12/1974 | Smith | 366/347 |
| 3,912,118 | A | | 10/1975 | Bird | |
| 4,060,176 | A | | 11/1977 | Tobiasson | |
| 4,171,047 | A | | 10/1979 | Doyle et al. | |
| 4,380,305 | A | | 4/1983 | Von Holdt | |
| 4,444,795 | A | | 4/1984 | Weinstein | |
| 4,508,235 | A | | 4/1985 | Steele et al. | |
| 4,705,172 | A | | 11/1987 | Gage | |
| 4,747,510 | A | | 5/1988 | Mack | |
| 5,361,935 | A | | 11/1994 | Sagucio | |
| 5,409,131 | A | | 4/1995 | Phillips et al. | |
| D361,265 | S | | 8/1995 | Doxey | |
| 5,645,347 | A | * | 7/1997 | Draenert | 366/347 |
| D417,847 | S | * | 12/1999 | Rush et al. | |
| 6,068,875 | A | * | 5/2000 | Miller et al. | 426/519 |

* cited by examiner

*Primary Examiner*—Nathan J. Newhouse
(74) *Attorney, Agent, or Firm*—Burns, Doane, Swecker & Mathis, L.L.P.

(57) ABSTRACT

A container lid that is adapted to be placed on a container includes an upstanding side wall and a top wall. The top wall is provided with an opening or through hole for allowing the contents within the container to be mixed while the lid remains on the container. The top wall of the container lid is configured to strengthen and increase the rigidity of the portion of the top wall surrounding the opening. The container lid can also be provided with characteristics allowing the portion of the lid surrounding the opening to flex when a force is applied to the periphery of the opening.

6 Claims, 3 Drawing Sheets

CRACK-RESISTANT CONTAINER LID HAVING OPENING

This application is based on and claims priority under 35 U.S.C. §119(e) with respect to U.S. Provisional Patent Application No. 60/109,282 filed on Nov. 20, 1998.

FIELD OF THE INVENTION

The present invention generally relates to container lids. More particularly, the present invention pertains to a container lid having a centrally located opening for allowing mixing of the contents in the container.

BACKGROUND OF THE INVENTION

A known type of dessert product sold in food establishments is a soft ice cream type of product into which is mixed different mix-in items such as cookie pieces, sprinkles, chocolate pieces, etc. One way of making this type of dessert product involves placing soft ice cream and the mix-in items in a container from which the dessert is subsequently consumed. The container is outfitted with a specially constructed lid having a centrally located opening.

The lid 12 is illustrated in FIGS. 1–3 and includes a rim portion 14 for mounting the lid on the upper portion of the container, an upwardly inclined side wall 16 and a top wall 18. The side wall 16 is straight and tapers from a larger dimension adjacent the rim 14 to a smaller dimension at the top wall 18 of the lid. The side wall 16 is also provided with several spaced apart raised portions 20. As seen in FIGS. 2 and 3, the top wall 18 of the lid 12 extends radially inwardly and is provided with a centrally located through hole or opening 22.

To produce the dessert product, the soft ice cream and the mix-in items are placed in the container from which the resulting dessert will ultimately be consumed by the consumer. The container is outfitted with the lid shown in FIGS. 1–3, and the ice cream and mix-in items are then mixed together directly in the container. This is accomplished using a blender that is outfitted to receive a plastic spoon that functions as the mixing implement. The spoon is temporarily fixed in the blender, and then the container outfitted with the lid shown in FIGS. 1–3 is held so that the blending spoon extends through the central opening 22 in the lid 12. Through operation of the blender, the spoon mixes the ice cream and the mix-in items in the container. Once mixing is completed, the spoon is released from the blender and the covered container with the spoon is then served to the consumer. Using the spoon, the consumer can then consume the dessert product by way of the centrally located opening 22 in the lid 12 without the need for removing the lid from the container.

In practice, is has been found that the lid constructed in the manner illustrated in FIGS. 1–3 possesses certain disadvantages and drawbacks. During the mixing operation, the spoon that is stirring together the ice cream and mix-in items invariably contacts the periphery of the opening 22 in the lid. This has been found to cause undesirable cracks in the lid.

In light of the foregoing, a need exists for a lid that is well-suited to minimizing the risk of cracking in the lid in the event the spoon comes into contact with the periphery of the opening during the mixing operation.

SUMMARY OF THE INVENTION

Generally speaking, the present invention provides a container lid that is adapted to be placed on a container includes an upstanding side wall and a top wall. The top wall is provided with a centrally located opening or through hole that allows the contents within the container to be mixed while the lid remains on the container. The top wall of the container lid is configured to strengthen and increase the rigidity of the portion of the top wall surrounding the opening. The container lid can also be provided with characteristics allowing the portion of the lid surrounding the opening to flex when a force is applied to the periphery of the opening.

According to one aspect of the invention, a container lid that is positionable on the top of a container includes a rim for engaging the rim of the container, an upstanding side wall extending from the rim, and a top wall located at the upper end of the side wall. The top wall is provided with a generally centrally located opening of a size which, upon positioning the lid on a container containing contents, permits passage of an implement for mixing or consuming the contents in the container. The top wall includes a first top wall portion and a second top wall portion, with the second top wall portion being axially displaced relative to the first top wall portion.

Another aspect of the invention involves the combination of a container and a container lid. The container includes an open top, and a generally cylindrically shaped sidewall and a closed bottom which together define a container interior. The container lid is adapted to be secured to the top of the container and includes a rim, an upstanding side wall and a top wall. The top wall is provided with a generally centrally located opening for providing access to the container interior when the container lid is placed on the container. The top wall of the container lid is defined by a first top wall portion and a second top wall portion that are axially displaced from one another, with the generally centrally located opening being provided in the second top wall portion.

BRIEF DESCRIPTION OF THE DRAWING FIGURES

Additional features and characteristics of the present invention will become more apparent from the following detailed description considered with reference to the accompanying drawing figures in which like elements are designated by like reference numerals and wherein.

DETAILED DESCRIPTION OF THE INVENTION

The present invention provides a container lid that is adapted to be placed on the top of a container, with the lid possessing a top wall in which is formed an opening for allowing the contents of the container to be mixed and subsequently consumed. The top wall of the container lid is constructed in a way that imparts additional strength and rigidity to the portion of the top wall surrounding the opening to thereby minimize the possibility of crack occurrence in the top wall of the container lid in the event the mixing implement contacts the periphery of the opening. In addition, the top wall of the container lid can be constructed to possess not only increased strength and rigidity, but flexibility characteristics as well. This allows the portion of the top wall of the container which surrounds the opening to flex in the event the mixing implement contacts the periphery of the opening.

Figure 4:
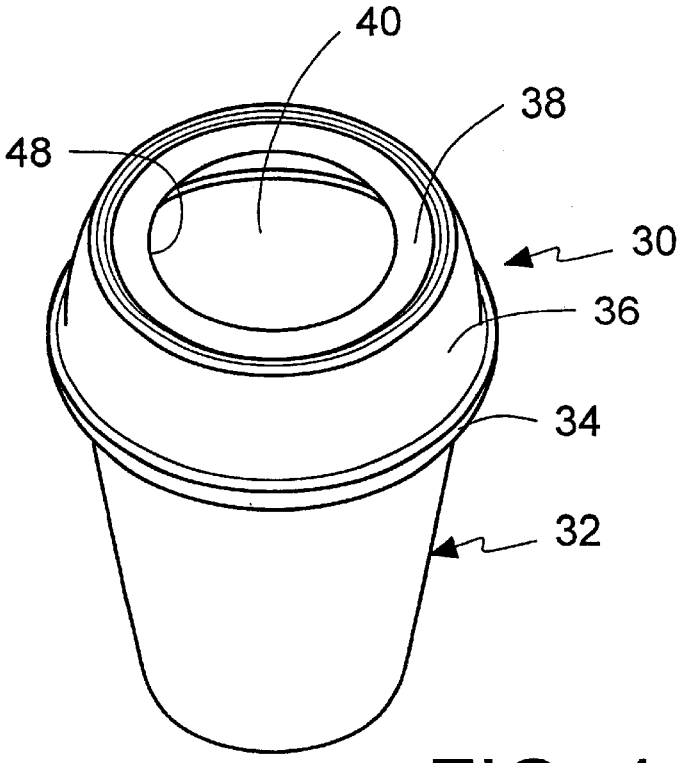
FIG. 4 is a top perspective view of one embodiment of the container lid according to the present invention positioned on a container.

Referring initially to FIG. 4, the container lid 30 according to the present invention is made of plastic material and is adapted to be mounted on a container 32 (e.g., a paperboard container). The container 32 is illustrated as being generally cylindrical in shape, with a generally cylindrical sidewall having a tapering configuration that narrows from the top of the container to the bottom of the container. However, it is to be understood that the container 32 can possess other shapes and configurations, so long as the container lid 30 is appropriately configured to be mounted on the container 32. The container 32 also includes a closed bottom and an open top, with a rim located at the upper end of the container sidewall.

As generally illustrated in FIG. 4, the container lid 30 includes a rim portion 34, an upstanding side wall 36 and a top wall 38. The rim portion 34 located at the bottom of the lid 30 and extending circumferentially about the lid 30 is adapted to engage the rim at the upper end of the container 32 to secure the lid 30 on the container 32. The top wall 38 of the container lid 30 is provided with a single generally centrally located through hole or opening 40. As seen with reference to FIG. 5, the container lid 30 is dome-shaped, with the side wall 36 of the lid possessing a gently curved configuration. However, the container lid 30 can alternatively possess a side wall that is straight.

Figure 5:
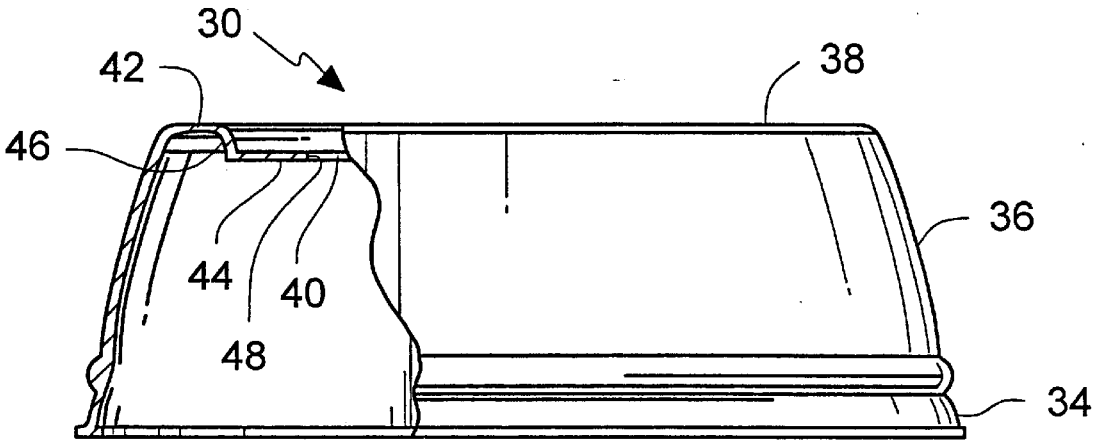
FIG. 5 is an enlarged cross-sectional view of the container lid shown in FIG. 4.

As shown in detail in FIG. 5, the top wall 38 of the container lid 30 includes a first top wall portion 42 and a second top wall portion 44. The first and second top wall portions 42, 44 are generally parallel to one another in the illustrated embodiment shown in FIG. 5. Both the first top wall portion 42 and the second top wall portion 44 extend radially inwardly. Also, the gently curved side wall 36 merges into the first top wall portion 42. The first and second sidewall portions 42, 44 are generally planar, although it is to be understood that variations are possible. For example, the first top wall 42 may possess a gently curved configuration rather than being strictly planar.

The first and second top wall portions 42, 44 of the top wall 38 of the lid are connected together by a generally axially inwardly extending interconnecting wall portion 46. By virtue of the axially inwardly extending interconnecting wall portion 46, the second top wall portion 44 is spaced downwardly from the first top wall portion 42 in the axial direction. It is also possible however to construct the container lid so that the second top wall portion 44 is spaced upwardly from the first top wall portion 42 in the axial direction. In addition, the through hole or opening 40 in the top wall 38 of the container is positioned in the second top wall portion 44. Consequently, the through hole or opening 40 is disposed in a portion of top wall 38 that is axially recessed relative to the top end of the container lid.

Figures 1, 3:
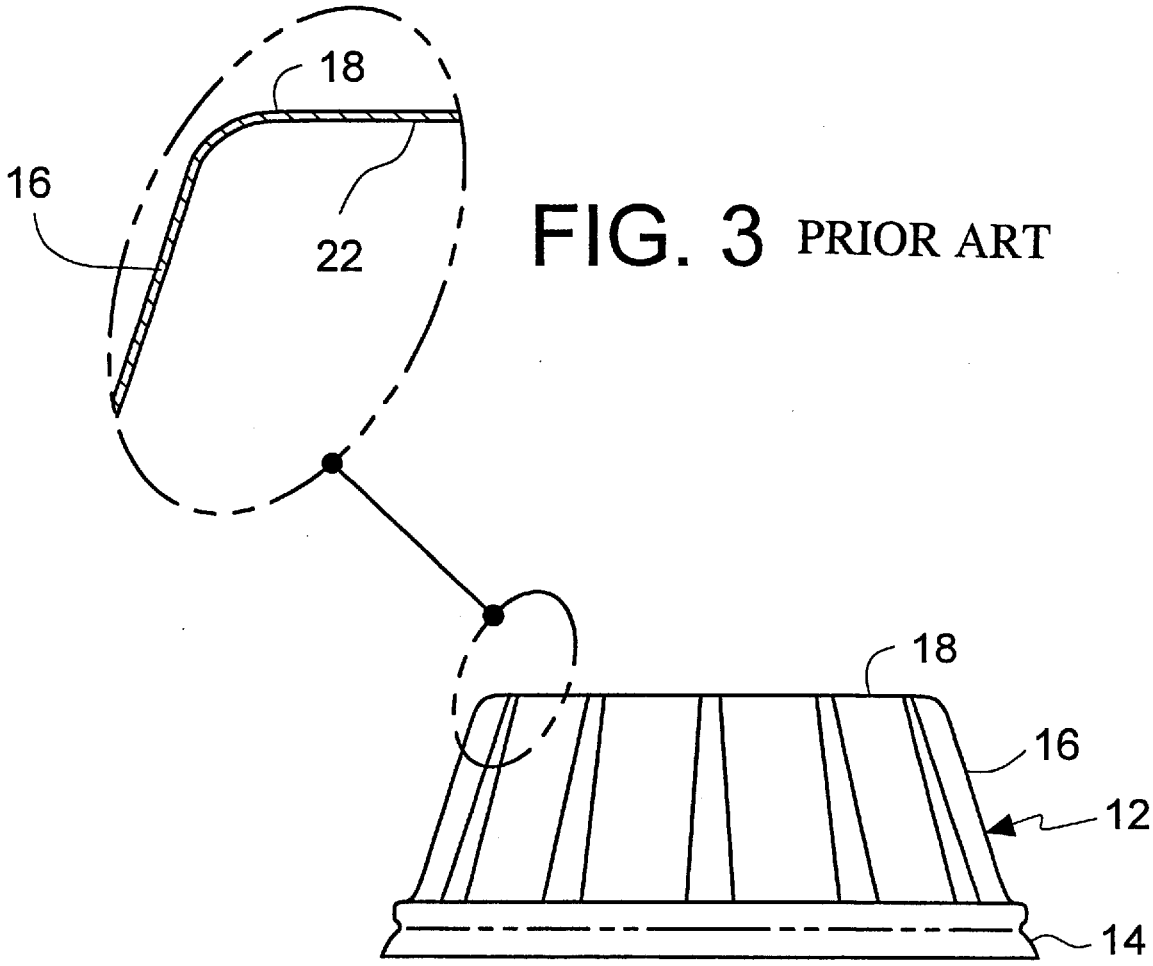
FIG. 3 PRIOR ART
FIG. 1 PRIOR ART
FIG. 1 is a side view of a known type of container lid.
FIG. 3 is an enlarged cross-sectional view of the circled portion of the container lid shown in FIG. 1.
Figure 2:
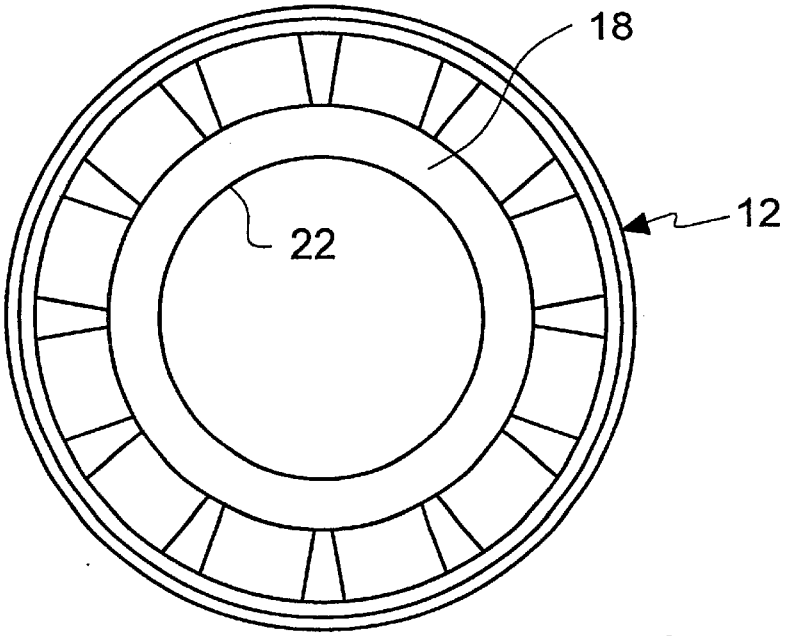
FIG. 2 PRIOR ART
FIG. 2 is a top view of the container lid shown in FIG. 1.

The downturn in the top wall 38 of the container lid 30 that is provided by the axially inwardly extending interconnecting wall portion 46 advantageously increases the strength and rigidity of the top wall 38 of the container. That is, as compared to the known lid construction shown in FIG. 3 in which the entire top wall of the lid is positioned in the same plane, the three-dimensional lid construction shown in FIG. 5 imparts increased strength and rigidity to the container lid 30, particularly the top wall 38 of the container lid. Thus, when used in the manner described above in which contents are mixed within the container 32 with the lid 30 in place on the cup 32, the container lid 30 is less susceptible to cracking in the event the mixing implement (e.g., the spoon) contacts the inner periphery 48 of the opening 40 in the container lid 30.

Figure 6:
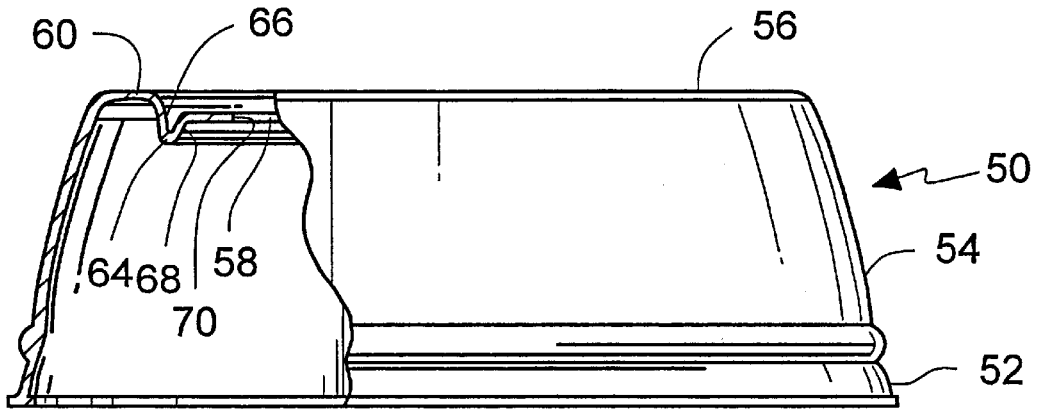
FIG. 6 is a cross-sectional view of a container lid in accordance with another embodiment of the present invention.

Another embodiment of the container lid 50 is illustrated in FIG. 6 and is also designed to impart greater strength and structural rigidity to the lid. In addition, the embodiment of the container lid illustrated in FIG. 6 incorporates a degree of flexibility into the top wall of the container lid so that if an impact force contacts the container lid, the periphery of the opening in the lid is able to yield slightly and absorb the force, thus reducing the possibility that the container lid will crack.

As seen in FIG. 6, the plastic container lid 50 includes a rim 52 for mounting the container lid on a container similar to that shown in FIG. 4, an upstanding side wall 54 and a top wall 56. As seen from FIG. 6, the side wall 54 of the container lid is gently curved to define a generally dome-shaped container lid 50. However, the container lid 30 can alternatively possess a side wall that is straight. The top wall 56 of the container lid is provided with a single centrally located through hole or opening 58.

The top wall 56 of the container lid is defined by a radially inwardly extending first top wall portion 60, a radially inwardly extending second top wall portion 62, and an interconnecting wall portion 64. The gently curved side wall 54 of the container lid merges into the first top wall portion 60.

The interconnecting wall portion 64 is generally V-shaped and includes an axially inwardly oriented first wall segment 66 extending from the first top wall portion 60 and an axially outwardly oriented second wall segment 68 extending from the first wall segment to the second top wall portion 62. The first and second wall segments 66, 68 together form the interconnecting wall portion 64.

The downturn in the top wall 56 provided by the first wall segment 66 is advantageous in that it strengthens and imparts rigidity to the top wall 56 of the container lid 50. Thus, when the lid is used in the manner described above in which contents are mixed within the container with the lid 50 positioned on the cup, the container lid 50 is less susceptible to cracking in the event the mixing implement (e.g., the spoon) contacts the inner periphery 70 of the opening 58 in the container lid 50. Moreover, the upturned second wall segment 68 functions as an accordion hinge for imparting flexibility to the top wall 56. If the mixing implement contacts the periphery of the opening 58, the second wall segment is able to flex outwardly, thus absorbing the impact and making it less likely that the top wall of the container lid will crack. The construction of the top wall 56 shown in FIG. 6 is particularly effective in minimizing or reducing the possibility of cracking in the top wall upon the application of a lateral force, but can also provide similar advantages with respect to upward or downward forces.

As described above, the container lid of the present invention has particular application for use with containers in which the contents are mixed within the container with a spoon while the lid is positioned on the container. For this reason, the generally centrally located opening 40, 58 in the container lid must be of sufficiently large size to permit the passage of a spoon through the opening and allow such mixing with the spoon when the container lid is positioned on the container. The opening should also preferably be large enough to allow the contents in the container to be removed from the container with a spoon while the container lid is in place on the container. Considering the foregoing, the opening 40, 58 may have a diameter or other corresponding dimension that is greater than 25% of the diameter X of the container lid as shown in FIGS. 5 and 6, preferably greater than 40% of the diameter X of the container lid, and most preferably between about 50% and about 60% of the diameter X of the container lid. For a container lid having a diameter X of 3.65 inches, the diameter or other corresponding dimension of the opening 40, 58 may be greater than 1.0 inches, preferably greater than 1.5 inches, and should most preferably be about 2.0 inches.

The axially inwardly extending interconnecting wall portion 46 shown in FIG. 5 can be angled relative to the vertical at an angle less than 40° and preferably less than 25°, with the angle of the axially inwardly extending interconnecting wall portion 46 most preferably being on the order of approximately 15°. The first wall segment 66 of the embodiment shown in FIG. 6 is also angled relative to the vertical at an angle of less than 40° and preferably less than 25°, with the angle of the first wall segment 66 relative to the vertical most preferably being on the order of approximately 15°. The second wall segment 68 of the embodiment shown in FIG. 6 is also angled relative to the vertical at an angle of less than 50° and preferably less than 40°, with the angle of the second wall segment 68 relative to the vertical most preferably being on the order of approximately 30°.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A combination of a container and a container lid, the container comprising a generally cylindrically shaped side wall and a closed bottom together defining a container interior, said container having an open top;

the container lid being adapted to be secured to the top of the container and comprising a rim, an upstanding side wall and a top wall, said top wall being provided with a generally centrally located opening for providing access to the container interior when the container lid is placed on the container, said top wall of the container lid comprising a first top wall portion and a second top wall portion that are axially displaced from one another, said generally centrally located opening being provided in the second top wall portion; and an interconnecting wall portion connecting the first top wall portion to the second top wall portion, said interconnecting wall portion including a first wall segment which is configured to impart strength and rigidity to the top wall of the container lid and a second wall segment which is configured to flex outwardly upon being contacted by an implement to impart flexibility to the top wall of the container lid, said first and second wall segments being differently oriented.

2. A container lid positionable on a top of a container comprising: a rim for engaging a rim of the container; an upstanding side wall extending from the rim; and a top wall located at an upper end of the side wall, said top wall including a generally centrally located opening of a size which, upon positioning the lid on a container containing contents, permits passage of an implement for mixing or consuming the contents in the container, said top wall including a first top wall portion and a second top wall portion, said second top wall portion being axially displaced relative to said first top wall portion; an interconnecting wall portion connecting the first top wall portion to the second top wall portion, said interconnecting wall portion including a first wall segment which is configured to impart strength and rigidity to the top wall of the container lid and a second wall segment which is configured to flex outwardly upon being contacted by an implement to impart flexibility to the top wall of the container lid, said first and second wall segments being differently oriented.

3. A combination of a container and a container lid, the container comprising a generally cylindrically shaped side wall and a closed bottom together defining a container interior, said container having an open top and an upper edge;

the container lid being adapted to be secured to the top of the container and comprising a rim, an upstanding side wall and a top wall, said upstanding side wall extending above the upper edge of the container when the container lid is placed on the container, said top wall being provided with a generally centrally located opening for providing access to the container interior when the container lid is placed on the container, said top wall of the container lid comprising a first top wall portion and a second top wall portion that are axially displaced from one another, the second top wall portion having a uniform thickness throughout, said generally centrally located opening having an inner periphery being provided in the second top wall portion, the second top wall portion being planar and extending in a radially inward direction terminating at the inner periphery of the central opening.

4. A container lid positionable on a top of a container comprising: a rim for engaging a rim of the container; an upstanding side wall extending from the rim and extending above the rim of the container when positioned on the top of the container; and a top wall located at an upper end of the upstanding side wall, said top wall including a generally centrally located opening of a size which, upon positioning the lid on a container containing contents, permits passage of an implement for mixing or consuming the contents in the container, said top wall including a first top wall portion and a second top wall portion, said second top wall portion being axially displaced relative to said first top wall portion, the second top wall portion having a uniform thickness throughout, said generally centrally located opening having an inner periphery being provided in the second top wall portion, the second top wall portion being planar and extending in a radially inward direction terminating at the inner periphery of the central opening.

5. A combination of a container and a container lid, the container comprising a generally cylindrically shaped side wall and a closed bottom together defining a container interior, said container having an open top;

the container lid being adapted to be secured to the top of the container and comprising a rim, an upstanding side wall and a top wall, said top wall being provided with a generally centrally located opening for providing access to the container interior when the container lid is placed on the container, said top wall of the container lid comprising a first top wall portion and a second top wall portion that are axially displaced from one another, said generally centrally located opening being provided in the second top wall portion; and an interconnecting wall portion connecting the first top wall portion to the second top wall portion, said interconnecting wall portion including a first wall segment which is configured to impart strength and rigidity to the top wall of the container lid and a second wall segment which is configured to flex outwardly upon being contacted by an implement to impart flexibility to the top wall of the container lid, said first and second wall segments being differently oriented; wherein one of the first wall segment and the second wall segment extends axially inwardly and the other of the first and second wall segments extends axially outwardly.

6. A combination of a container and a container lid, the container comprising a generally cylindrically shaped side wall and a closed bottom together defining a container interior, said container having an open top;

the container lid being adapted to be secured to the top of the container and comprising a rim, an upstanding side wall and a top wall, said top wall being provided with a generally centrally located opening for providing access to the container interior when the container lid is placed on the container, said top wall of the container lid comprising a first top wall portion and a second top wall portion that are axially displaced from one another, said generally centrally located opening being provided in the second top wall portion; and an interconnecting wall portion connecting the first top wall portion to the second top wall portion, said interconnecting wall portion including a first wall segment which is configured to impart strength and rigidity to the top wall of the container lid and a second wall segment which is configured to flex outwardly upon being contacted by an implement to impart flexibility to the top wall of the container lid, said first and second wall segments being differently oriented; wherein the first wall segment is located radially outwardly of the second wall segment.

* * * * *